US006558156B2

(12) United States Patent
Wong

(10) Patent No.: US 6,558,156 B2
(45) Date of Patent: May 6, 2003

(54) MULTI-FLAME LIGHTER

(76) Inventor: Chi Lam Wong, 834 W. Duarte Rd., #13, Arcadia, CA (US) 91007

( * ) Notice: Subject to any disclaimer, the term of this patent is extended or adjusted under 35 U.S.C. 154(b) by 0 days.

(21) Appl. No.: 09/915,066

(22) Filed: Jul. 25, 2001

(65) Prior Publication Data

US 2003/0022119 A1 Jan. 30, 2003

(51) Int. Cl.[7] ..... F23D 14/04; F23D 14/48; F23D 14/38; F23D 2/16

(52) U.S. Cl. ..... 431/266; 431/255; 431/344; 431/350; 431/354; 431/349

(58) Field of Search ..... 431/349, 344, 431/266, 354, 355, 286

(56) References Cited

U.S. PATENT DOCUMENTS

| | | | | |
|---|---|---|---|---|
| 434,013 | A | * | 8/1890 | Barker |
| 1,024,443 | A | * | 4/1912 | Gault, Jr. |
| 1,160,329 | A | * | 11/1915 | Rutz |
| 1,231,726 | A | * | 7/1917 | Gault, Jr. |
| 1,296,507 | A | * | 3/1919 | Hansen |
| 1,884,764 | A | * | 10/1932 | Lonergan |
| 1,971,554 | A | * | 8/1934 | Forster |
| 2,005,801 | A | * | 6/1935 | Olsen |
| 2,462,704 | A | * | 2/1949 | Zink |
| 2,737,234 | A | * | 3/1956 | Reed |
| 2,888,980 | A | * | 6/1959 | Williams et al. |
| 3,304,014 | A | * | 2/1967 | Hancock et al. |
| 3,850,571 | A | * | 11/1974 | Zink et al. |
| 5,711,662 | A | * | 1/1998 | Ishiguro |

FOREIGN PATENT DOCUMENTS

| | | | | |
|---|---|---|---|---|
| DE | 2035563 | * | 1/1972 | ..... 431/354 |
| JP | 5-240434 | * | 9/1993 | ..... 431/344 |
| JP | 10-238773 | * | 8/1998 | ..... 431/344 |

* cited by examiner

*Primary Examiner*—Carl D. Price
(74) *Attorney, Agent, or Firm*—Joe Nieh

(57) ABSTRACT

A multi-flame lighter includes a housing, an igniter, a liquid fuel supply, a valve, a vaporizer, a mixing chamber, a nozzle, and a flame chamber. The multi-flame lighter produces clearly visible and forceful flames that are aesthetically pleasing and functional being equivalent to 2 or more of the flames from a conventional tighter as well as being particularly wind resistant. The multiple clearly visible and forceful flames allow a user to easily aim the cigarette or cigar to quickly achieve ignition and easily ignite the cigarette or cigar for ignition and easily ignite the cigarette of cigar with the multiple clearly visible flames.

20 Claims, 9 Drawing Sheets

图 26

MULTI-FLAME LIGHTER

BACKGROUND

1. Field of Invention

The present invention relates to a lighter that is commonly used to light cigarette and cigars. The lighter of the present invention produces multiple visible flames that are aesthetically pleasing, functional, and wind resistant.

2. Description of Related Art

A lighter is a common tool that replaces matches as a source of fire to ignite cigarettes and cigars. The lighter is easier to carry and safer than matches. The lighter is also more aesthetically pleasing. Furthermore, depending on the design, a lighter is generally more wind resistant than a match.

A lighter commonly uses a combustible gas in a liquid state as fuel. The gas is released through valves and ignited with an ignition mean such as the piezoelectric igniter. Once ignited, the visible flame produced can be used to ignite cigarettes and cigars. Generally, the flame produced is a single visible flame that is in the shape of a water droplet. The flame is susceptible to extinguishment by winds. The single flame is often difficult to aim and therefore difficult to ignite cigarettes and, particularly, cigars.

SUMMARY OF THE INVENTION

The present invention is a multi-flame lighter which comprises of a housing, an ignition mean, a fuel housing containing combustible liquid fuel, a valve, a connecting tube, an adjustable valve, a vaporizer, a mixing chamber, a nozzle, and a flame chamber. The present invention requires far fewer parts than any existing lighters that can produce multiple clearly visible flames. The manufacturing and parts cost of the present invention is much lower than the existing lighters that can produce multiple flames due to the single valve, connecting tube, single adjustable valve, single vaporizer, single mixing chamber, and single nozzle configuration. The multi-flame lighter produces multiple clearly visible flames that are both aesthetically pleasing and functional. The multiple visible and forceful flames are equivalent to 2 or more of the flames from a conventional lighter and are wind resistant. The multiple visible flames may be in various configurations and shapes.

DETAILED DESCRIPTION OF THE PREFERRED EMBODIMENT

Figure 1:
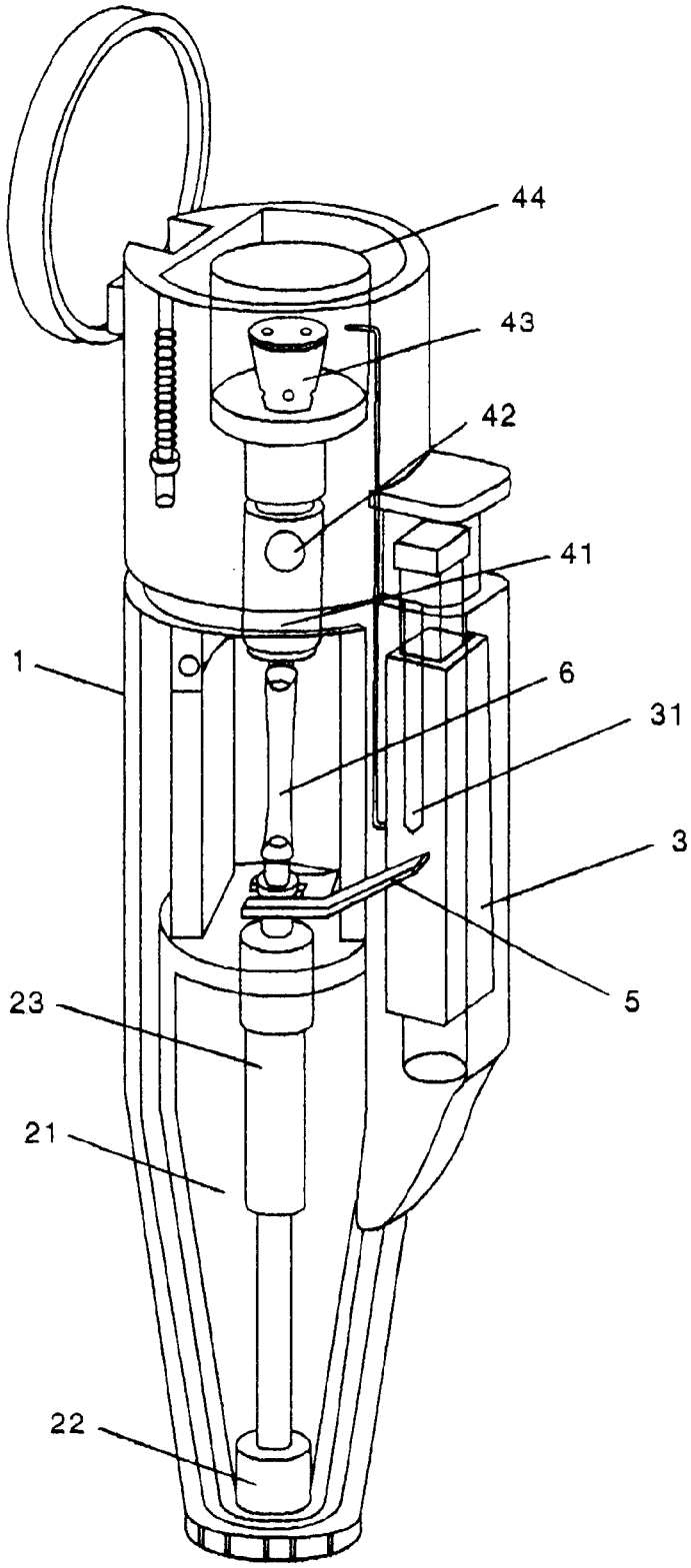
FIG. 1 shows a preferred embodiment of the multi-flame lighter with its various components.

The preferred embodiment of the present invention is shown in FIG. 1. The multi-flame lighter comprises of a housing 1, an ignition mean 3 rigidly attached to interior of said housing 1, a fuel housing 21 enclosed within said housing 1, a valve 22 within said fuel housing 21, an adjustable valve 23 connected to said valve 22, a valve actuation lever 5 pivotally connected to said adjustable valve 23 and in contact with the ignition mean 3, a connection tube 6 that connects the adjustable valve 23 to the vaporizer 41. A mixing chamber 42 is rigidly attached on top of the vaporizer 41. A nozzle 43 is rigidly attached on top of the mixing chamber 42. Surrounding the nozzle 43 is a flame chamber 44 rigidly attached to the circumference of the lower portion of the nozzle 43.

The preferred embodiment of the present invention is operated by depressing the button on the ignition mean 3 whereby the combustible gas is allowed to escape from the fuel housing 21 through the valve 22 and adjustable valve 23, through the connection tube 6, into the vaporizer 41 wherein the fuel is vaporized, then into the mixing chamber 42 wherein the vaporized fuel is mixed with air, and finally through the channels in the nozzle 43 and ignited by the ignition mean 3 to produce multiple flames at the exit of the nozzle 43 and the flame chamber 44. Releasing the button on the ignition mean 3 will shut off the adjustable valve 23 and stop the flow of combustible gas thereby extinguish the flames at the exit of the nozzle 43 and the flame chamber 44.

Figure 2:
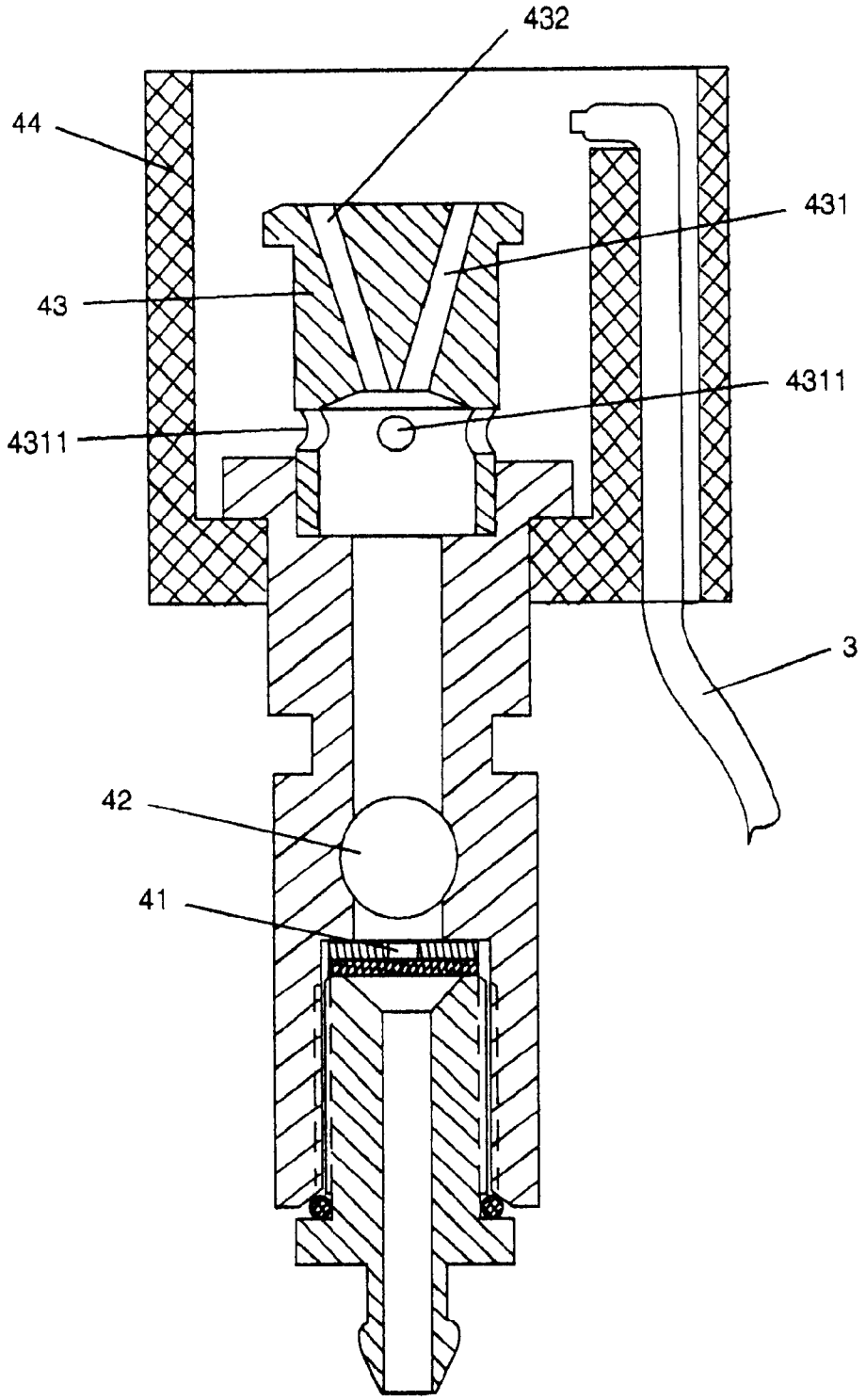
FIG. 2 shows a cross-sectional view of a preferred embodiment of the vaporizer, mixing chamber, and nozzle with two angled channels of the multi-flame lighter.

FIG. 2 is a detailed enlarged view of the preferred embodiment of the nozzle 43. The escaping combustible fuel is release through the vaporizer 41 into a mixing chamber 42. The mixing chamber 42 has openings that allows outside air to interact with and mix with the combustible fuel in the mixing chamber 42 thereby creating a combustible air/fuel mixture. The combustible air/fuel mixture then proceeds to the nozzle 43. The base of the nozzle 43 contains a hollow chamber. The nozzle 43 has multiple diversion channels 4311 near the base of the nozzle 43 surrounding said hollow chamber. The diversion channels 4311 will divert a small portion of the combustible air/fuel mixture to the flame chamber 44. The majority of the combustible air/fuel mixture will escape through a first side angled channel 431 and a second side angled channel 432 within said nozzle 43. The first side angled channel 431 and the second side angled channel 432 are oriented in the shape of the letter "V" with respect to each other. The ignition mean 3 will ignite the combustible air/fuel mixture exiting through the nozzle 43 and in the flame chamber 44. A flame will be produced above each of the openings of the first side angled channel 431 and the second side angled channel 432 in the nozzle 43. A wall of flame will also be produced around said flames above the openings from within the flame chamber 44. The wall of flame surrounding the flames will shield the flames from wind and increase the flames' wind resistance.

Figure 3:
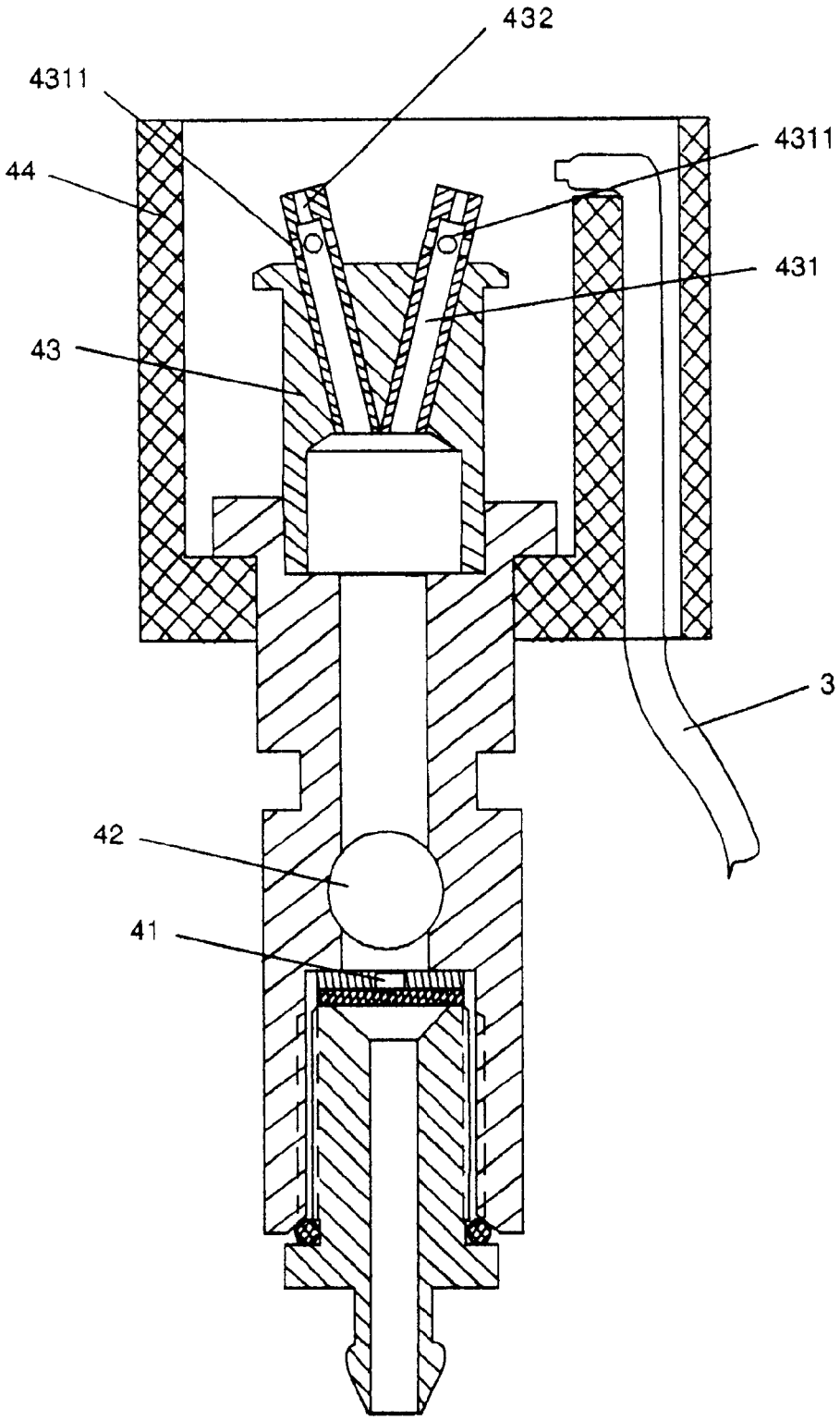
FIG. 3 shows a cross-sectional view of another embodiment of the vaporizer, mixing chamber, and nozzle with two angled channels of the multi-flame lighter.

FIG. 3 is a detailed enlarged view of another embodiment of the nozzle 43. The escaping combustible fuel is release through the vaporizer 41 into a mixing chamber 42. The mixing chamber 42 has openings that allows outside air to interact with and mix with the combustible fuel in the mixing chamber 42 thereby creating a combustible air/fuel mixture. The combustible air/fuel mixture then proceeds to the nozzle 43. The base of the nozzle 43 contains a hollow chamber. Above the chamber, the nozzle 43 has a first side angled channel 431 and a second side angled channel 432. Both side angled channels 431, 432 extend a short distance above the top of the nozzle 43. Just before the exit of each of the two channels are multiple diversion channels 4311. The diversion channels 4311 will divert a small portion of the combustible air/fuel mixture to the flame chamber 44. The majority of the combustible air/fuel mixture will escape through the first side angled channel 431 and the second side angled channel 432. The exit of each of the side angled channels 431, 432 has a smaller diameter than the remaining portions of the side angled channel 431, 432. The first side angled channel 431 and the second side angled channel 432 are oriented in the shape of the letter "V" with respect to each other. The ignition mean 3 will ignite the combustible air/fuel mixture exiting through the nozzle 43 and in the flame chamber 44. A flame will be produced above each of the openings of the first side angled channel 431 and the second side angled channel 432 in the nozzle 43. A wall of flame will also be produced around said flames above the openings from within the flame chamber 44. The wall of flame surrounding the flames will shield the flames from wind and increase the flames' wind resistance.

Figure 4:
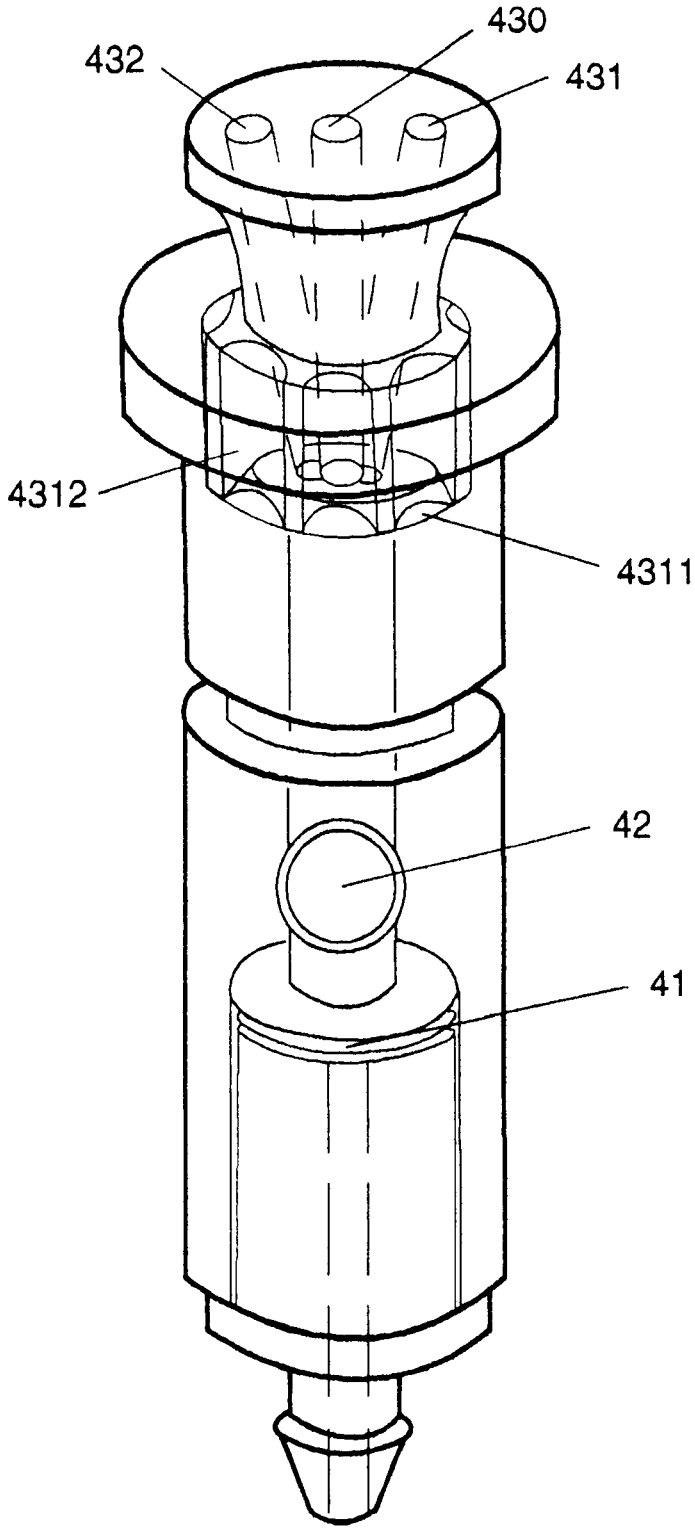
FIG. 4 shows another embodiment of the vaporizer, mixing chamber, and nozzle with three angled channels and multiple gear channels of the multi-flame lighter.

FIG. 4 is a detailed enlarged view of another embodiment of the nozzle 43. The escaping combustible fuel is release through the vaporizer 41 into a mixing chamber 42. The mixing chamber 42 has openings that allows outside air to interact with and mix with the combustible fuel in the mixing chamber 42 thereby creating a combustible air/fuel mixture. The combustible air/fuel mixture then proceeds to the nozzle 43. At the base of the nozzle 43, in the shape of a gear, are multiple diversion channels 4311 exiting through the gear channels 4312. The diversion channels 4311 will divert a small portion of the combustible air/fuel mixture through the gear channels 4312 to the flame chamber 44. The majority of the combustible air/fuel mixture will escape through a first side angled channel 431, a second side angled channel 432, and a central channel 430 within said nozzle 43. The first side angled channel 431 and the second side angled channel 432 are oriented in the shape of the letter "V" with respect to each other. The central channel 430 is perpendicular to the base of the nozzle 43. The ignition mean 3 will ignite the combustible air/fuel mixture exiting through the nozzle 43 and in the flame chamber 44. A flame will be produced above each of the openings of the first side angled channel 431, the second side angled channel 432, and the central channel 430 in the nozzle 43. A wall of flame will also be produced around said flames above the openings from within the flame chamber 44. The wall of flame surrounding the flames will shield the flames from wind and increase the flames' wind resistance.

Figure 5:
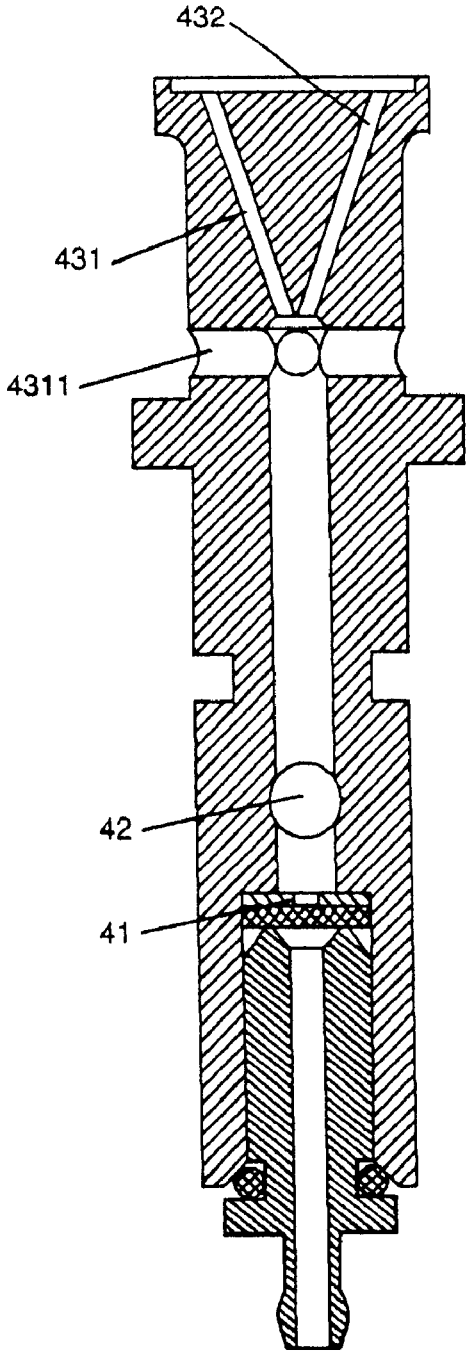
FIG. 5 shows a cross-sectional view of another embodiment of the vaporizer, mixing chamber, and nozzle with two angled channels of the multi-flame lighter.

FIG. 5 is a detailed enlarged view of another embodiment of the nozzle 43. The escaping combustible fuel is release through the vaporizer 41 into a mixing chamber 42. The mixing chamber 42 has openings that allows outside air to interact with and mix with the combustible fuel in the mixing chamber 42 thereby creating a combustible air/fuel mixture. The combustible air/fuel mixture then proceeds to the nozzle 43. The nozzle 43 has multiple diversion channels 4311 near the base of the nozzle 43. The diversion channels 4311 will divert a small portion of the combustible air/fuel mixture to the flame chamber 44. The majority of the combustible air/fuel mixture will escape through a first side angled channel 431 and a second side angled channel 432 within said nozzle 43. The first side angled channel 431 and the second side angled channel 432 are oriented in the shape of the letter "V" with respect to each other. The ignition mean 3 will ignite the combustible air/fuel mixture exiting through the nozzle 43 and in the flame chamber 44. A flame will be produced above each of the openings of the first side angled channel 431 and the second side angled channel 432 in the nozzle 43. A wall of flame will also be produced around said flames above the openings from within the flame chamber 44. The wall of flame surrounding the flames will shield the flames from wind and increase the flames' wind resistance.

Figure 6:
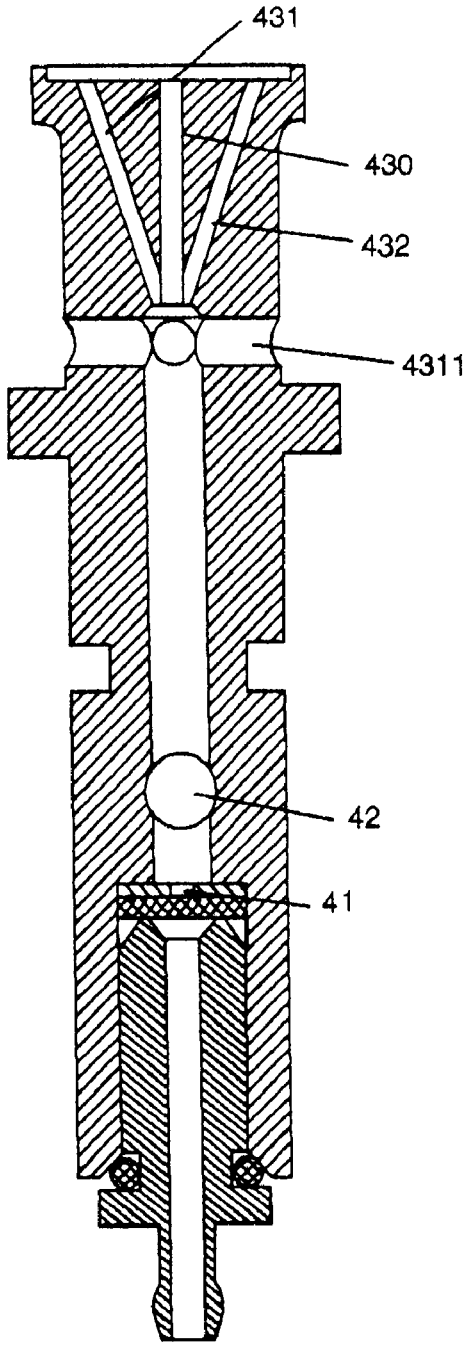
FIG. 6 shows a cross-sectional view of another embodiment of the vaporizer, mixing chamber, and nozzle with three angled channels of the multi-flame lighter.

FIG. 6 is a detailed enlarged view of another embodiment of the nozzle 43. The escaping combustible fuel is release through the vaporizer 41 into a mixing chamber 42. The mixing chamber 42 has openings that allows outside air to interact with and mix with the combustible fuel in the mixing chamber 42 thereby creating a combustible air/fuel mixture. The combustible air/fuel mixture then proceeds to the nozzle 43. The nozzle 43 has multiple diversion channels 4311 near the base of the nozzle 43. The diversion channels 4311 will divert a small portion of the combustible air/fuel mixture to the flame chamber 44. The majority of the combustible air/fuel mixture will escape through a first side angled channel 431, a second side angled channel 432, and a central channel 430 within said nozzle 43. The first side angled channel 431 and the second side angled channel 432 are oriented in the shape of the letter "V" with respect to each other. The central channel 430 is perpendicular to the base of the nozzle 43. The ignition mean 3 will ignite the combustible air/fuel mixture exiting through the nozzle 43 and in the flame chamber 44. A flame will be produced above each of the openings of the first side angled channel 431, the second side angled channel 432, and the central channel 430 in the nozzle 43. A wall of flame will also be produced around said flames above the openings from within the flame chamber 44. The wall of flame surrounding the flames will shield the flames from wind and increase the flames' wind resistance.

Figure 7:
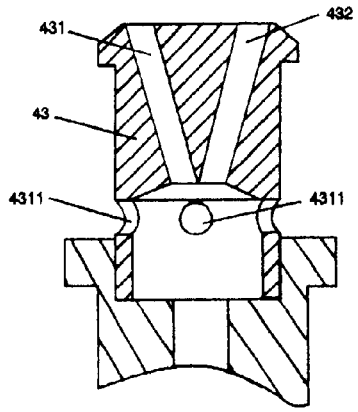
FIG. 7 shows a cross-sectional view of another embodiment of the nozzle with two angled channels of the multi-flame lighter.

FIG. 7 is a detailed enlarged view of another embodiment of the nozzle 43. The base of the nozzle 43 contains a hollow chamber. The nozzle 43 has multiple diversion channels 4311 near the base of the nozzle 43 surrounding said hollow chamber. The diversion 4311 channels will divert a small portion of the combustible air/fuel mixture to the flame chamber 44. The majority of the combustible air/fuel mixture will escape through a first side angled channel 431 and a second side angled channel 432 within said nozzle 43. The first side angled channel 431 and the second side angled channel 432 are oriented in the shape of the letter "V" with respect to each other.

Figure 8:
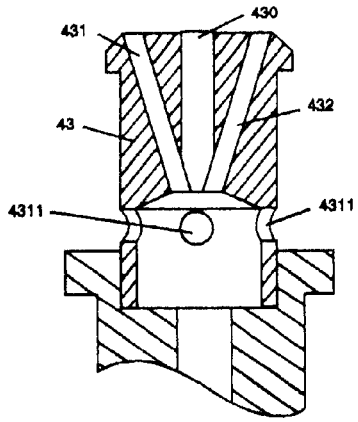
FIG. 8 shows a cross-sectional view of another embodiment of the nozzle with three angled channels of the multi-flame lighter.

FIG. 8 is a detailed enlarged view of another embodiment of the nozzle 43. The base of the nozzle 43 contains a hollow chamber. The nozzle 43 has multiple diversion channels 4311 near the base of the nozzle 43 surrounding said hollow chamber. The diversion channels 4311 will divert a small portion of the combustible air/fuel mixture to the flame chamber 44. The majority of the combustible air/fuel mixture will escape through a first side angled channel 431, a second side angled channel 432, and a central channel 430 within said nozzle 43. The first side angled channel 431 and the second side angled channel 432 are oriented in the shape of the letter "V" with respect to each other. The central channel 430 is perpendicular to the base of the nozzle 43.

Figure 9:
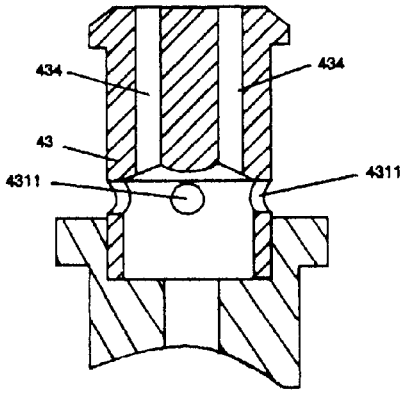
FIG. 9 shows a cross-sectional view of another embodiment of the nozzle with two parallel channels of the multi-flame lighter.

FIG. 9 is a detailed enlarged view of another embodiment of the nozzle 43. The base of the nozzle 43 contains a hollow chamber. The nozzle 43 has multiple diversion channels 4311 near the base of the nozzle 43 surrounding said hollow chamber. The diversion channels 4311 will divert a small portion of the combustible air/fuel mixture to the flame chamber 44. The majority of the combustible air/fuel mixture will escape through two parallel channels 434 within said nozzle 43.

Figure 10:
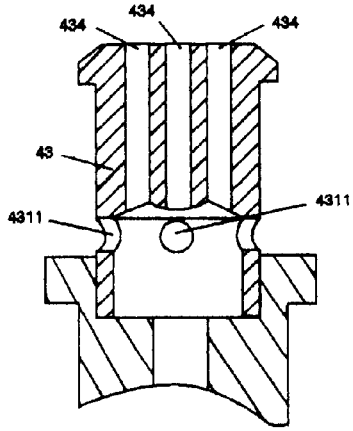
FIG. 10 shows a cross-sectional view of another embodiment of the nozzle with three parallel channels of the multi-flame lighter.

FIG. 10 is a detailed enlarged view of another embodiment of the nozzle 43. The base of the nozzle 43 contains a hollow chamber. The nozzle 43 has multiple diversion channels 4311 near the base of the nozzle 43 surrounding said hollow chamber. The diversion channels 4311 will divert a small portion of the combustible air/fuel mixture to the flame chamber 44. The majority of the combustible air/fuel mixture will escape through multiple parallel channels 434 within said nozzle 43.

Figure 11:
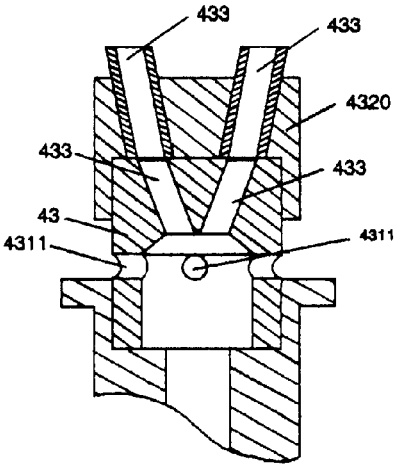
FIG. 11 shows a cross-sectional view of another embodiment of the nozzle with two angled channels with an angled extension of the multi-flame lighter.

FIG. 11 is a detailed enlarged view of another embodiment of the nozzle 43. The base of the nozzle 43 contains a hollow chamber. The nozzle 43 has multiple diversion channels 4311 near the base of the nozzle 43 surrounding said hollow chamber. The diversion channels 4311 will divert a small portion of the combustible air/fuel mixture to the flame chamber 44. The majority of the combustible air/fuel mixture will escape through two side angled bent channels 433 within said nozzle 43. The two side angled bent channel 433 are oriented in the shape of the letter "V" with respect to each other. On top of the nozzle 43 is affixed a side angle bent channel angel extension 4320.

Figure 12:
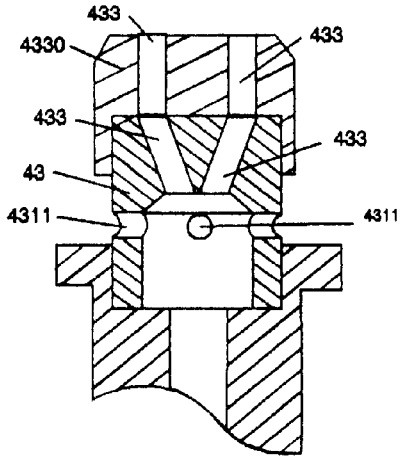
FIG. 12 shows a cross-sectional view of another embodiment of the nozzle with two angled channels with a straight extension of the multi-flame lighter.

FIG. 12 is a detailed enlarged view of another embodiment of the nozzle 43. The base of the nozzle 43 contains a hollow chamber. The nozzle 43 has multiple diversion channels 4311 near the base of the nozzle 43 surrounding said hollow chamber. The diversion channels 4311 will divert a small portion of the combustible air/fuel mixture to the flame chamber 44. The majority of the combustible air/fuel mixture will escape through two side angled bent channels 433 within said nozzle 43. The two side angled bent channel 433 are oriented in the shape of the letter "V" with respect to each other. On top of the nozzle 43 is affixed a side angle bent channel straight extension 4330.

Figure 13:
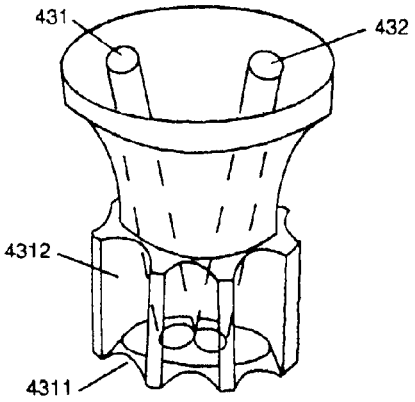
FIG. 13 shows another embodiment of the nozzle with two angled channels and multiple gear channels of the multi-flame lighter.

FIG. 13 is a detailed enlarged view of another embodiment of the nozzle 43. At the base of the nozzle 43, in the shape of a gear, are multiple diversion channels 4311 exiting through the gear channels 4312. The diversion channels 4311 will divert a small portion of the combustible air/fuel mixture through the gear channels 4312 to the flame chamber 44. The majority of the combustible air/fuel mixture will escape through a first side angled channel 431 and a second side angled channel 432 within said nozzle 43. The first side angled channel 431 and the second side angled channel 432 are oriented in the shape of the letter "V" with respect to each other.

Figure 14:
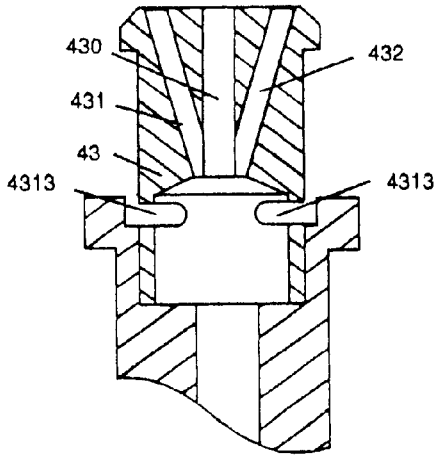
FIG. 14 shows a cross-sectional view of another embodiment of the nozzle with three angled channels and horizontal cutouts of the multi-flame lighter.

FIG. 14 is a detailed enlarged view of another embodiment of the nozzle 43. The base of the nozzle 43 contains a hollow chamber. The nozzle 43 has multiple horizontal cutouts 4313 near the base of the nozzle 43 surrounding said hollow chamber. The horizontal cutouts 4313 will divert a small portion of the combustible air/fuel mixture to the flame chamber 44. The majority of the combustible air/fuel mixture will escape through a first side angled channel 431, a second side angled channel 432, and a central channel 430 within said nozzle 43. The first side angled channel 431 and the second side angled channel 432 are oriented in the shape of the letter "V" with respect to each other. The central channel 430 is perpendicular to the base of the nozzle 43.

Figure 15:
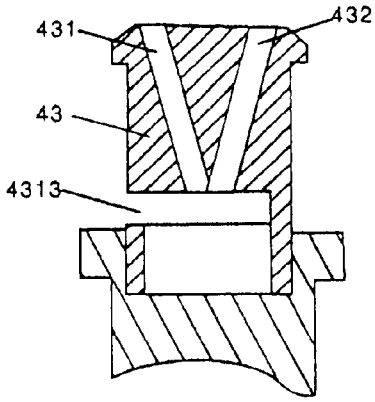
FIG. 15 shows a cross-sectional view of another embodiment of the nozzle with two angled channels and a horizontal cutout of the multi-flame lighter.

FIG. 15 is a detailed enlarged view of another embodiment of the nozzle 43. The base of the nozzle 43 contains a hollow chamber. The nozzle 43 has a large horizontal cutout 4313 near the base of the nozzle 43 surrounding said hollow chamber. The large horizontal cutout 4313 will divert a small portion of the combustible air/fuel mixture to the flame chamber 44. The majority of the combustible air/fuel mixture will escape through a first side angled channel 431 and a second side angled channel 432 within said nozzle 43. The first side angled channel 431 and the second side angled channel 432 are oriented in the shape of the letter "V" with respect to each other.

Figure 16:
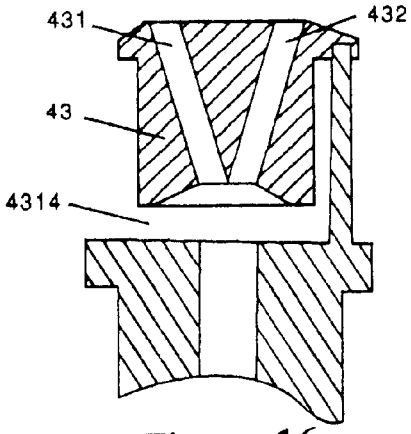
FIG. 16 shows a cross-sectional view of another embodiment of the nozzle with two angled channels and a horizontal cutout of the multi-flame lighter.

FIG. 16 is a detailed enlarged view of another embodiment of the nozzle 43. The base of the nozzle 43 contains a hollow chamber. The nozzle 43 has a large horizontal channel 4314 near the base of the nozzle 43 surrounding said hollow chamber. The large horizontal channel 4314 will divert a small portion of the combustible air/fuel mixture to the flame chamber 44. The majority of the combustible air/fuel mixture will escape through a first side angled channel 431 and a second side angled channel 432 within said nozzle 43. The first side angled channel 431 and the second side angled channel 432 are oriented in the shape of the letter "V" with respect to each other.

Figure 17:
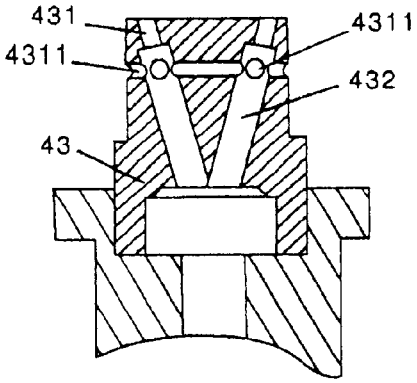
FIG. 17 shows a cross-sectional view of another embodiment of the nozzle with two angled channels of the multi-flame lighter.

FIG. 17 is a detailed enlarged view of another embodiment of the nozzle 43. The base of the nozzle 43 contains a hollow chamber. Above the chamber, the nozzle 43 has a first side angled channel 431 and a second side angled channel 432. Just before the exit of each of the two channels 431, 432 are multiple diversion channels 4311. The diversion channels 4311 will divert a small portion of the combustible air/fuel mixture to the flame chamber 44. The majority of the combustible air/fuel mixture will escape through the first side angled channel 431 and the second side angled channel 432. The exit of each of the side angled channels 431, 432 has a smaller diameter than the remaining portions of the side angled channels 431, 432. The first side angled channel 431 and the second side angled channel 432 are oriented in the shape of the letter "V" with respect to each other.

Figure 18:
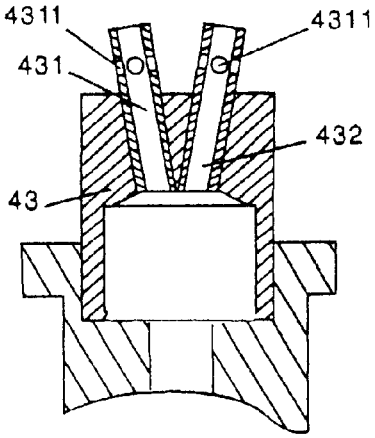
FIG. 18 shows a cross-sectional view of another embodiment of the nozzle with two angled channels of the multi-flame lighter.

FIG. 18 is a detailed enlarged view of another embodiment of the nozzle 43. The base of the nozzle 43 contains a hollow chamber. Above the chamber, the nozzle 43 has a first side angled channel 431 and a second side angled channel 432. Both side angled channels 431, 432 extend a short distance above the top of the nozzle 43. Just before the exit of each of the two channels are multiple diversion channels 4311. The diversion channels 4311 will divert a small portion of the combustible air/fuel mixture to the flame chamber 44. The majority of the combustible air/fuel mixture will escape through the first side angled channel 431 and the second side angled channel 432. The first side angled channel 431 and the second side angled channel 432 are oriented in the shape of the letter "V" with respect to each other.

Figure 19:
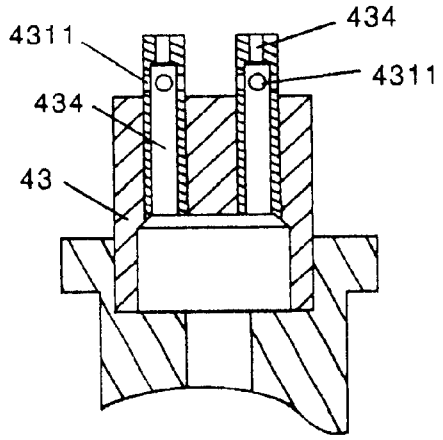
FIG. 19 shows a cross-sectional view of another embodiment of the nozzle with two parallel channels of the multi-flame lighter.

FIG. 19 is a detailed enlarged view of another embodiment of the nozzle 43. The base of the nozzle 43 contains a hollow chamber. Above the chamber, the nozzle 43 has two parallel channels 434. Both parallel channels 434 extend a short distance above the top of the nozzle 43. Just before the exit of each of the two parallel channels 434 are multiple diversion channels 4311. The diversion channels 4311 will divert a small portion of the combustible air/fuel mixture to the flame chamber 44. The majority of the combustible air/fuel mixture will escape through the parallel channels 434. The exit of each of the parallel channels 434 has a smaller diameter than the remaining portions of the parallel channels 434.

Figure 20:
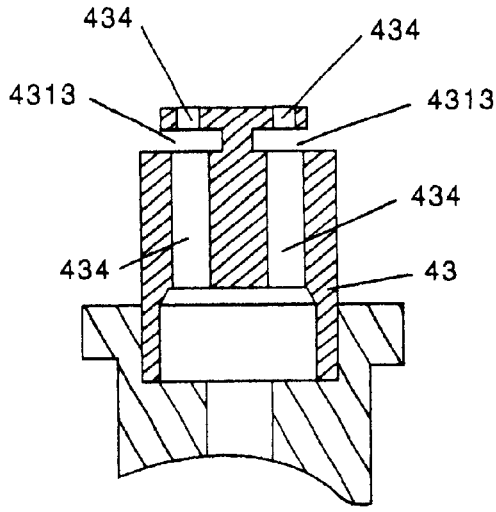
FIG. 20 shows a cross-sectional view of another embodiment of the nozzle with two parallel channels of the multi-flame lighter.

FIG. 20 is a detailed enlarged view of another embodiment of the nozzle 43. The base of the nozzle 43 contains a hollow chamber. Above the chamber, the nozzle 43 has two parallel channels 434. Just before the exit of each of the two parallel channels 434 are horizontal cutouts 4313. The horizontal cutouts 4313 will divert a small portion of the combustible air/fuel mixture to the flame chamber 44. The majority of the combustible air/fuel mixture will escape through the parallel channels 434. The exit of each of the parallel channels 434 has a smaller diameter than the remaining portions of the parallel channels 434.

Figure 21:
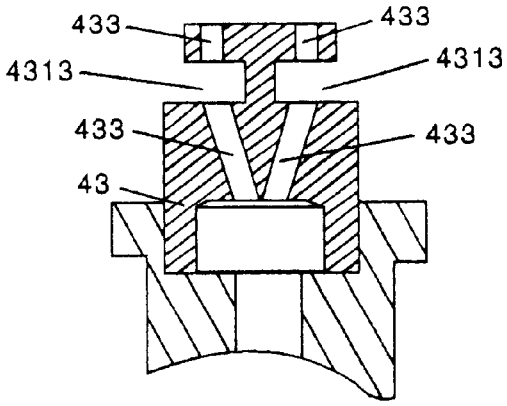
FIG. 21 shows a cross-sectional view of another embodiment of the nozzle with two angled channels of the multi-flame lighter.

FIG. 21 is a detailed enlarged view of another embodiment of the nozzle 43. The base of the nozzle 43 contains a hollow chamber. Above the chamber, the nozzle 43 has two side angled bent channel 433. Just before the exit of each of the two side angled bent channels 433 are horizontal cutouts 4313. The horizontal cutouts 4313 will divert a small portion of the combustible air/fuel mixture to the flame chamber 44. The majority of the combustible air/fuel mixture will escape through the two side angled bent channels 433. The two side angled bent channels 433 are oriented in the shape of the letter "V" with respect to each other and become parallel to each other after the horizontal cutout 4313.

Figure 22:
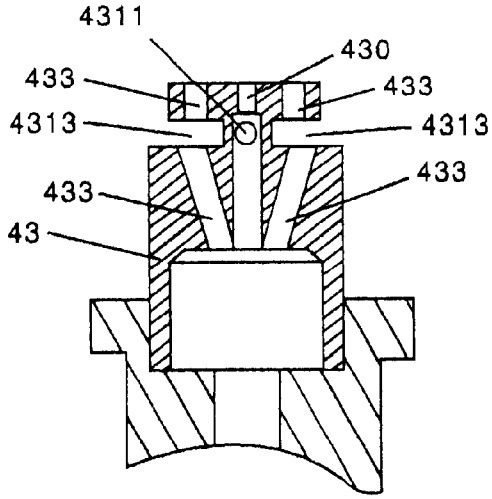
FIG. 22 shows a cross-sectional view of another embodiment of the nozzle with two angled channels of the multi-flame lighter.

FIG. 22 is a detailed enlarged view of another embodiment of the nozzle 43. The base of the nozzle 43 contains a hollow chamber. Above the chamber, the nozzle 43 has two side angled bent channel 433 and a central channel 430. Just before the exit of each of the two side angled bent channels 433 are horizontal cutouts 4313. The horizontal cutouts 4313 will divert a small portion of the combustible air/fuel mixture to the flame chamber 44. Just before the exit of the central channel 430 is a diversion channel 4311. The diversion channel 4311 will divert a small portion of the combustible air/fuel mixture to the flame chamber 44. The majority of the combustible air/fuel mixture will escape through the two side angled bent channels 433 and the central channel 430. The exit of each of the two side angled bent channel 433 and the central channel 430 has a smaller diameter than the remaining portions of the side angled bent channel 433 and the central channel 430. The two side angled bent channels 433 are oriented in the shape of the letter "V" with respect to each other and become parallel to each other after the horizontal cutout 4313. The central channel 430 is perpendicular to the base of the nozzle 43.

Figure 23:
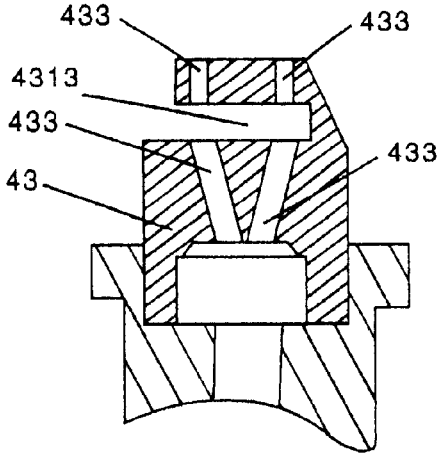
FIG. 23 shows a cross-sectional view of another embodiment of the nozzle with two angled channels of the multi-flame lighter.

FIG. 23 is a detailed enlarged view of another embodiment of the nozzle 43. The base of the nozzle 43 contains a hollow chamber. Above the chamber, the nozzle 43 has two side angled bent channel 433. Just before the exit of both of the two side angled bent channels 433 is a large horizontal cutout 4313. The large horizontal cutout 4313 will divert a small portion of the combustible air/fuel mixture to the flame chamber 44. The majority of the combustible air/fuel mixture will escape through the two side angled bent channels 433. The two side angled bent channels 433 are oriented in the shape of the letter "V" with respect to each other and become parallel to each other after the large horizontal cutout 4313. The exit of each of the two side angled bent channel 433 has a smaller diameter than the remaining portions of the side angled bent channel 433.

Figure 24:
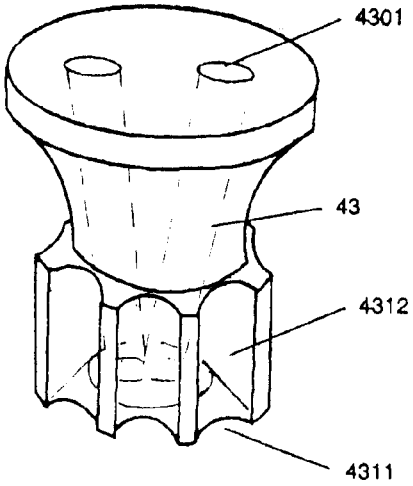
FIG. 24 shows another embodiment of the nozzle with two elliptical channel exits and multiple gear channels of the multi-flame lighter.

FIG. 24 is a detailed enlarged view of another embodiment of the nozzle 43. At the base of the nozzle 43, in the shape of a gear, are multiple diversion channels 4311 exiting through the gear channels 4312. The diversion channels 4311 will divert a small portion of the combustible air/fuel mixture through the gear channels 4312 to the flame chamber 44. The majority of the combustible air/fuel mixture will escape through multiple elliptical channel exits 4301 to produce multiple elliptical shaped flames.

Figure 25:
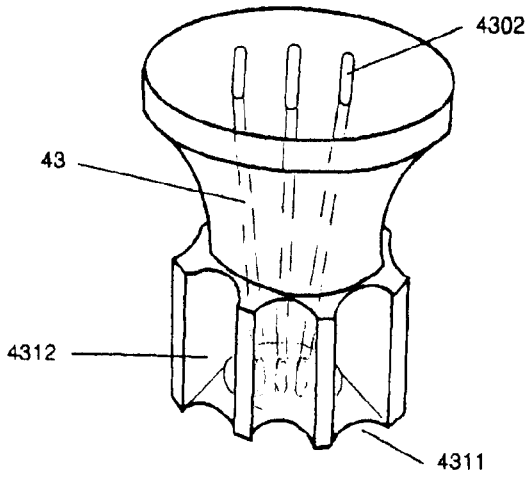
FIG. 25 shows another embodiment of the nozzle with three elongated channel exits and multiple gear channels of the multi-flame lighter.

FIG. 25 is a detailed enlarged view of another embodiment of the nozzle 43. At the base of the nozzle 43, in the shape of a gear, are multiple diversion channels 4311 exiting through the gear channels 4312. The diversion channels

4311 will divert a small portion of the combustible air/fuel mixture through the gear channels 4312 to the flame chamber 44. The majority of the combustible air/fuel mixture will escape through multiple elongated channel exits 4302 to produce multiple elongated shaped flames.

Figure 26:
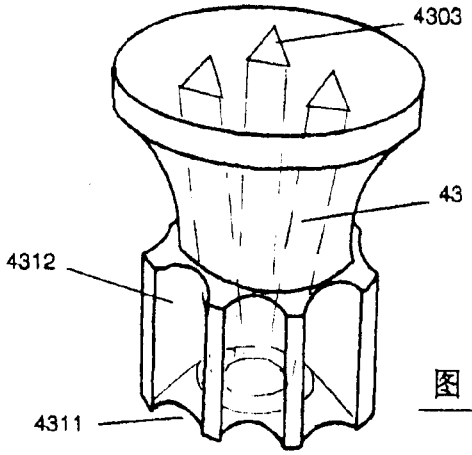
FIG. 26 shows another embodiment of the nozzle with three triangular channel exits and multiple gear channels of the multi-flame lighter.

FIG. 26 is a detailed enlarged view of another embodiment of the nozzle 43. At the base of the nozzle 43, in the shape of a gear, are multiple diversion channels 4311 exiting through the gear channels 4312. The diversion channels 4311 will divert a small portion of the combustible air/fuel mixture through the gear channels 4312 to the flame chamber 44. The majority of the combustible air/fuel mixture will escape through multiple triangular channel exits 4303 to produce multiple triangular shaped flames.

Figure 27:
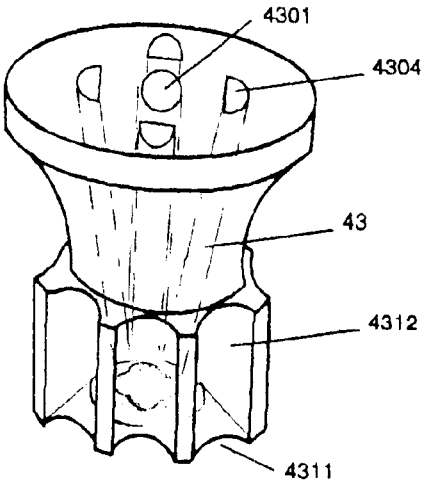
FIG. 27 shows another embodiment of the nozzle with a combination of an elliptical channel exit and four semicircular channel exits and multiple gear channels of the multi-flame lighter.

FIG. 27 is a detailed enlarged view of another embodiment of the nozzle 43. At the base of the nozzle 43, in the shape of a gear, are multiple diversion channels 4311 exiting through the gear channels 4312. The diversion channels 4311 will divert a small portion of the combustible air/fuel mixture through the gear channels 4312 to the flame chamber 44. The majority of the combustible air/fuel mixture will escape through an elliptical channel exit 4301 in the center with multiple semicircular channel exits 4304 around the elliptical channel exit 4301 to produce multiple semicircular shaped flames surrounding the elliptical flame in the center.

Figure 28:
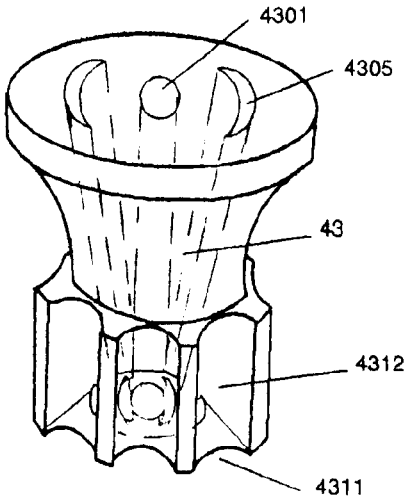
FIG. 28 shows another embodiment of the nozzle with a combination of an elliptical channel exit and two crescent channel exits and multiple gear channels of the multi-flame lighter.

FIG. 28 is a detailed enlarged view of another embodiment of the nozzle 43. At the base of the nozzle 43, in the shape of a gear, are multiple diversion channels 4311 exiting through the gear channels 4312. The diversion channels 4311 will divert a small portion of the combustible air/fuel mixture through the gear channels 4312 to the flame chamber 44. The majority of the combustible air/fuel mixture will escape through an elliptical channel exit 4301 in the center of the nozzle 43 and multiple crescent channel exits 4305 to produce an elliptical shaped flame in the center surrounded by multiple crescent shaped flames.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A multi-flame lighter for a combustible liquid fuel, comprising:

(a) a housing;

(b) nozzle body supported by the housing and forming at least a top end of a mixing chamber;

(c) a valve fluid-connected to the mixing chamber for coupling a pressurized supply of the fuel into the mixing chamber;

(d) a vaporizer interposed between the valve and the mixing chamber, the vaporizer comprising a small diameter orifice forming an inlet of the mixing chamber and the mixing chamber having an opening for admitting air into the mixing chamber proximate the inlet for mixing with the fuel to produce a fuel mixture as a burst of vaporized combustible gas when the valve is open;

(e) a plurality of elongate nozzle passages extending upwardly through the nozzle body from proximate the top end of the mixing chamber;

(f) each of the nozzle passages having a nozzle outlet associated therewith in fluid communication with the mixing chamber through the associated passage for feeding respective primary flames;

(g) a diverter path in fluid communication with the mixing chamber and extending outwardly from below the nozzle outlets, the diverter path being configured to permit only a minor portion of the fuel mixture to flow therethrough and being ignitable to form a secondary flame, a major portion of the mixture flowing from the nozzle openings when the pressurized fuel is flowing into the mixing chamber;

(h) an igniter supported relative to the nozzle body for igniting the secondary flame, the igniter being coupled for activation simultaneously with opening of the valve;

(i) the nozzle outlets being sized and sufficiently spaced to form the primary flames as respective distinct and forceful elongate flames; and (j) the secondary flame being sufficiently proximate the nozzle outlets to ignite and sustain the distinct and forceful elongate flames.

2. The multi-flame lighter of claim 1, wherein the diverter path is formed by a plurality of circumferentially spaced diverter passages.

3. The multi-flame lighter of claim 2, wherein the diverter passages, being formed in the nozzle body, extend generally radially from proximate the top end of the mixing chamber.

4. The multi-flame lighter of claim 2, wherein the diverter passages are formed below and proximate the nozzle outlets.

5. The multi-flame lighter of claim 4, wherein the nozzle passages extend upwardly beyond a main portion of the nozzle body in respective tubular portions, the diverter passages forming respective side openings of the tubular portions.

6. The multi-flame lighter of claim 2, wherein the nozzle body is seated in a chamber member forming a lower portion of the mixing chamber, the diverter passages extending in respective axially oriented channels between the nozzle body and the chamber member.

7. The multi-flame lighter of claim 1, wherein the diverter path comprises a transverse slot, at least an upper boundary of the transverse slot being a surface of the nozzle body.

8. The multi-flame lighter of claim 7, wherein the transverse slot intersects the mixing chamber proximate the top end thereof.

9. The multi-flame lighter of claim 7, wherein the transverse slot intersects at least one of the nozzle passages.

10. The multi-flame lighter of claim 1, wherein the nozzle passages have divergent, V-shaped orientations.

11. The multi-flame lighter of claim 10, wherein the nozzle body has at least three of the nozzle passages formed therein, the three nozzle passages being oriented in a common plane.

12. The multi-flame lighter of claim 10, wherein respective upper portions of the nozzle passages are inclined inwardly relative to corresponding lower portions thereof.

13. The multi-flame lighter of claim 12, wherein upper extremities of the nozzle passages are in parallel-spaced relation.

14. The multi-flame lighter of claim 1, wherein at least some of the nozzle outlets are non-circular.

15. The multi-flame lighter of claim 1, wherein at least some of the nozzle outlets have shapes selected from the set consisting of elliptical, triangular, semicircular, crescent-shaped, and elongate slit-shaped for forming proximal portions of the forceful flames with corresponding cross-sectional shapes.

16. The multi-flame lighter of claim 1, wherein at least some of the nozzle outlets are restricted in cross-sectional area relative to corresponding ones of the nozzle passages.

17. The multi-flame lighter of claim 1, further comprising a wall member projecting outwardly and upwardly from the nozzle body to form an annular flame chamber, the diverter passages being in fluid communication with the flame chamber for forming the secondary flame as an annular flame, the flame chamber projecting in cylindrical relation to the top end of the mixing chamber from below the top end of the mixing chamber to beyond the nozzle outlets for shielding the nozzle outlets from wind and for extending the annular form of the secondary flame as a wall of flame to further shield the primary flames from wind.

18. A multi-flame lighter for a combustible fuel, comprising:

(a) a nozzle body forming at least a top end of a mixing chamber;

(b) means for coupling the mixing chamber through a valve to a pressurized supply of the fuel;

(c) means for admitting air into the mixing chamber for mixing with the fuel to produce a fuel mixture;

(d) a plurality of nozzle passages extending upwardly through the nozzle body from proximate the top end of the mixing chamber;

(e) each of the nozzle passages having a nozzle outlet associated therewith in fluid communication with the mixing chamber through the associated passage;

(f) a wall member projecting outwardly and upwardly from the nozzle body to form an annular flame chamber, the flame chamber projecting in cylindrical relation to the top end of the mixing chamber from below the top end of the mixing chamber to beyond the nozzle outlets for shielding the nozzle outlets from wind;

(g) a plurality of circumferentially spaced diverter passages extending outwardly from the mixing chamber into fluid communication with the flame chamber, the diverter passages being sized to permit only a minor portion of the fuel mixture to flow into the flame chamber and being ignitable to form an annular ring of flame, a major portion of the mixture flowing from the nozzle openings when the pressurized fuel is coupled to the mixing chamber, (h) the nozzle outlets being sized and sufficiently spaced to form corresponding distinct and forceful elongate flames;

(i) the cylindrical form of the flame chamber extending to the top of the wall member for directing the ring of flame to form a cylindrical wall of flame for enhanced shielding of the nozzle outlets from wind, the wall of flame being sufficiently proximate the nozzle outlets to ignite and sustain the elongate flames.

19. The multi-flame lighter of claim 18, wherein at least some of the nozzle outlets are restricted in cross-sectional area relative to corresponding ones of the nozzle passages.

20. A multi-flame lighter for a combustible liquid fuel, comprising:

(a) a housing;

(b) a pressurized supply of the liquid fuel in the housing;

(c) a nozzle body forming at least a top end of a mixing chamber;

(d) a valve connected between the mixing chamber and the pressurized supply of fuel for selectively feeding the pressurized supply of fuel into the mixing chamber;

(e) a vaporizer interposed between the valve and the mixing chamber, the vaporizer comprising a small diameter orifice forming an inlet of the mixing chamber, the mixing chamber having an opening for admitting air into the mixing chamber proximate the inlet for mixing with the fuel to produce a vaporized fuel mixture;

(f) a plurality of elongate nozzle passages extending upwardly through the nozzle body from proximate the top end of the chamber;

(g) each of the nozzle passages having a nozzle outlet associated therewith in fluid communication with the chamber through the associated passage;

(h) a wall member projecting outwardly and upwardly from the nozzle body to form an annular flame chamber, the flame chamber projecting in cylindrical relation to the top end of the mixing chamber from below the top end of the mixing chamber to beyond the nozzle outlets for shielding the nozzle outlets from wind;

(i) a plurality of circumferentially spaced diverter passages in fluid communication between the mixing chamber and the flame chamber below the nozzle outlets, the diverter passages being sized to permit only a minor portion of the fuel mixture to flow therethrough and be ignitable to form an annular ring of flame, a major portion of the fuel mixture forcibly flowing from the nozzle openings when the pressurized fuel is flowing into the mixing chamber;

(j) an igniter positioned for igniting vaporized fuel in the flame chamber to produce the annular ring of flame, the igniter being coupled for activation simultaneously with opening of the valve;

(k) the nozzle outlets being sized and sufficiently spaced to form corresponding distinct and forceful elongate flames, the annular ring of flame being sufficiently proximate the nozzle outlets to ignite and sustain the elongate flames;

(l) the cylindrical form of the flame chamber extending to the top of the wall member for directing the ring of flame to form a cylindrical wall of flame for enhanced shielding of the nozzle outlets from wind;

(m) the wall of flame being sufficiently proximate the nozzle outlets to ignite and sustain the elongate flames, the elongate flames extending unobstructedly from within the flame chamber to beyond the top end of the flame chamber.

* * * * *